US012760895B2

(12) United States Patent
Walters et al.

(10) Patent No.: US 12,760,895 B2
(45) Date of Patent: Oct. 13, 2026

(54) DILUTION PASSAGES FOR COMBUSTOR OF A GAS TURBINE ENGINE

(71) Applicant: RTX Corporation, Farmington, CT (US)

(72) Inventors: Ian Walters, Corvallis, OR (US); Baris A. Sen, South Glastonbury, CT (US); Manuel J. Hernandez, Glastonbury, CT (US); Scott A. Liljenberg, Wethersfield, CT (US); Stephen K. Kramer, Cromwell, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/104,685

(22) Filed: Feb. 1, 2023

(65) Prior Publication Data

US 2024/0255146 A1 Aug. 1, 2024

(51) Int. Cl.
*F23R 3/06* (2006.01)
*F23R 3/00* (2006.01)

(52) U.S. Cl.
CPC ..... *F23R 3/06* (2013.01); *F23R 3/002* (2013.01)

(58) Field of Classification Search
CPC ..... F23R 3/002; F23R 3/06
See application file for complete search history.

(56) References Cited

U.S. PATENT DOCUMENTS 3,581,492 A 6/1971 Norgren et al.
4,132,066 A 1/1979 Austin, Jr. et al.
4,653,279 A 3/1987 Reynolds
4,887,432 A 12/1989 Mumford et al.
5,187,937 A 2/1993 Stevens et al.
5,235,805 A 8/1993 Barbier et al.
6,351,949 B1 3/2002 Rice et al.
7,395,669 B2 7/2008 Sherwood
7,891,194 B2 2/2011 Biebel et al.
9,062,884 B2 6/2015 Rudrapatna et al.
9,127,551 B2 9/2015 Narcus et al.
(Continued)

FOREIGN PATENT DOCUMENTS

GB 2353589 A * 2/2001 ..... F23R 3/002

OTHER PUBLICATIONS

International Search Report for International Application No. PCT/US2023/081862; Mailing Date, Mar. 15, 2024.
(Continued)

*Primary Examiner* — Thomas P Burke
(74) *Attorney, Agent, or Firm* — CANTOR COLBURN LLP

(57) ABSTRACT

A wall assembly for use in a combustor of a gas turbine engine, the wall assembly including: a support shell; a liner panel; and an annular grommet extending from the liner panel, the annular grommet defining a dilution passage and the annular grommet extends through an opening in the support shell when the support shell and the liner panel are secured to each other, the annular grommet having a top portion that defines a portion of a periphery of the dilution opening; and a backstop extending from the top portion of the annular grommet, the backstop defining another portion of the periphery of the dilution passage and the backstop extending through and above the opening in the support shell when the liner panel is secured to the support shell.

13 Claims, 6 Drawing Sheets

(56) References Cited

U.S. PATENT DOCUMENTS

| | | | | |
|---|---|---|---|---|
| 10,753,613 | B2 | 8/2020 | Mckenzie et al. | |
| 10,830,143 | B2 | 11/2020 | Choi | |
| 11,112,115 | B2 | 9/2021 | Kostka, Jr. et al. | |
| 11,268,438 | B2 | 3/2022 | Vise et al. | |
| 2003/0046934 | A1 | 3/2003 | Sherwood | |
| 2010/0000200 | A1 | 1/2010 | Smith | |
| 2010/0251723 | A1* | 10/2010 | Chen | F02C 7/18 60/760 |
| 2015/0285498 | A1 | 10/2015 | Cunha et al. | |
| 2016/0201908 | A1* | 7/2016 | Drake | F02C 7/18 415/115 |
| 2016/0209035 | A1 | 7/2016 | Cramer | |
| 2016/0238253 | A1 | 8/2016 | Moura et al. | |
| 2016/0265777 | A1* | 9/2016 | Hoke | F23R 3/002 |
| 2016/0334103 | A1* | 11/2016 | Eastwood | F23R 3/002 |
| 2019/0024895 | A1* | 1/2019 | Stickles | F23R 3/045 |
| 2020/0041127 | A1 | 2/2020 | Vukanti et al. | |
| 2020/0208840 | A1 | 7/2020 | Sauer et al. | |
| 2020/0277868 | A1* | 9/2020 | Hucker | F01D 9/023 |
| 2020/0363064 | A1 | 11/2020 | Gerendas | |
| 2022/0325891 | A1* | 10/2022 | Kediya | F23R 3/10 |
| 2022/0364729 | A1* | 11/2022 | Singh | F23R 3/002 |
| 2022/0390112 | A1 | 12/2022 | Ganiger et al. | |
| 2022/0390113 | A1 | 12/2022 | Ganiger et al. | |
| 2023/0125918 | A1 | 4/2023 | Thomson et al. | |
| 2023/0194087 | A1 | 6/2023 | Singh et al. | |
| 2023/0366548 | A1 | 11/2023 | Sampath et al. | |
| 2025/0283599 | A1* | 9/2025 | Snyder | F23R 3/002 |

OTHER PUBLICATIONS

Written Opinion for International Application No. PCT/US2023/081862; Mailing Date, Mar. 15, 2024.

Extended European Search Report corresponding to EP Application No. 25150256.3; Issue Date, Apr. 16, 2025, 10 pages.

International Preliminary Report on Patentability for International Application No. PCT/US2023/081862; Mailing date, Aug. 14, 2025, 7 pages.

U.S. Non-Final Office Action corresponding to U.S. Appl. No. 18/596,302; Issue date, Jun. 11, 2025, 46 pages.

EP Communication pursuant to Rules 161(1) and 162 EPC corresponding to EP Application No. 23837078.7; Issue date, Sep. 10, 2025, 4 pages.

U.S. Final Office Action corresponding to U.S. Appl. No. 18/596,302; Issue date, Jun. 3, 2026, 39 pages.

EPO Communication pursuant to Article 94(3) EPC corresponding to EP Application No. 23 837 078.7; Issue date, Jul. 22, 2026, 7 pages.

* cited by examiner

DILUTION PASSAGES FOR COMBUSTOR OF A GAS TURBINE ENGINE

BACKGROUND

The present disclosure relates to gas turbine engines and, more particularly, to a combustor section therefor.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The combustor section typically includes an outer shell lined with heat shields often referred to as floatwall panels which are attached to the outer shell with studs and nuts. In certain arrangements, dilution holes in the floatwall panel communicate with respective dilution holes in the outer shell to direct cooling air for dilution of the combustion gases. In addition to the dilution holes, the outer shell may also have relatively smaller air impingement holes to direct cooling air between the floatwall panels and the outer shell to cool the cold side of the floatwall panels. This cooling air exits effusion holes on the surface of the floatwall panels to form a film on a hot side of the floatwall panels which serves as a barrier against thermal damage.

One particular region where localized hot spots may arise is around the combustor dilution holes. The dilution holes inject relative lower temperature air into the swirling fuel-rich cross flow for combustion. As the air penetrates into the fuel-rich cross-stream, heat release takes place along the reaction front creating high temperature regions around the dilution holes. A stagnation region along the upstream side of the dilution jets also forms a higher pressure environment such that cross flow momentum deflects the incoming dilution jet. It is the combination of high pressure and the deflection of the incoming jet which is believed to create a high temperature recirculation region along the inner surface of the dilution hole. These high temperatures recirculation regions may affect the life of the turbine of the gas turbine engine as well as the cooling design of the turbine.

A lower velocity region of flow along the perimeter of the dilution hole may be highly susceptible to inflow of hot combustion gas products. The inflow of these products can occur within a localized ingestion region and may result in a durability concern because a low temperature boundary condition is replaced by high temperature gases.

BRIEF DESCRIPTION

Disclosed is a wall assembly for use in a combustor of a gas turbine engine, the wall assembly including: a support shell; a liner panel; and an annular grommet extending from the liner panel, the annular grommet defining a dilution passage and the annular grommet extends through an opening in the support shell when the support shell and the liner panel are secured to each other, the annular grommet having a top portion that defines a portion of a periphery of the dilution opening; and a backstop extending from the top portion of the annular grommet, the backstop defining another portion of the periphery of the dilution passage and the backstop extending through and above the opening in the support shell when the liner panel is secured to the support shell.

In addition to one or more of the features described above, or as an alternative to any of the foregoing embodiments, the backstop has a curvature that matches a curvature of a portion of the dilution passage.

In addition to one or more of the features described above, or as an alternative to any of the foregoing embodiments, a portion of an inner wall of the annular grommet includes a converging contoured inner wall portion that extends from the top portion to a bottom portion of the annular grommet, the bottom portion being opposite the top portion and located at a hot side of the liner panel.

In addition to one or more of the features described above, or as an alternative to any of the foregoing embodiments, the converging contoured inner wall portion has a first inner periphery defining a portion of a first cross-sectional area of the dilution passage and a second inner periphery defining a portion of a second cross-sectional area of the dilution passage, the second inner periphery being smaller than that of the first inner periphery.

In addition to one or more of the features described above, or as an alternative to any of the foregoing embodiments, the backstop has a curvature that matches a curvature of a portion of the dilution passage.

In addition to one or more of the features described above, or as an alternative to any of the foregoing embodiments, the converging contoured inner wall portion converges toward an axis of the dilution passage.

In addition to one or more of the features described above, or as an alternative to any of the foregoing embodiments, the backstop is arranged to be at least partially located at a trailing edge portion of the dilution passage.

In addition to one or more of the features described above, or as an alternative to any of the foregoing embodiments, a portion of an inner wall of the annular grommet includes a converging contoured inner wall portion that extends from the top portion to a bottom portion of the annular grommet, the bottom portion being opposite the top portion and located at a hot side of the liner panel and the converging contoured inner wall portion is located at a leading edge portion of the dilution passage.

In addition to one or more of the features described above, or as an alternative to any of the foregoing embodiments, the converging contoured inner wall portion is located at a leading edge portion of the dilution passage.

In addition to one or more of the features described above, or as an alternative to any of the foregoing embodiments, the first inner periphery and the second inner periphery define a portion of a contoured nozzle that forms local acceleration of airflow along a portion of a perimeter of the dilution passage.

In addition to one or more of the features described above, or as an alternative to any of the foregoing embodiments, the backstop has a vortex generator.

Also disclosed is a gas turbine engine, including: a compressor section; a turbine section; and a combustor section, the combustor section including a wall assembly for use in a combustor of the combustor section, the wall assembly comprising: a support shell: a liner panel; and an annular grommet extending from the liner panel, the annular grommet defining a dilution passage and the annular grommet extends through an opening in the support shell when the support shell and the liner panel are secured to each other, the annular grommet having a top portion that defines a portion of a periphery of the dilution opening; and a backstop extending from the top portion of the annular grommet, the backstop defining another portion of the periphery of the dilution passage and the backstop extending through and above the opening in the support shell when the liner panel is secured to the support shell.

In addition to one or more of the features described above, or as an alternative to any of the foregoing embodiments, the backstop has a curvature that matches a curvature of a portion of the dilution passage.

In addition to one or more of the features described above, or as an alternative to any of the foregoing embodiments, a portion of an inner wall of the annular grommet includes a converging contoured inner wall portion that extends from the top portion to a bottom portion of the annular grommet, the bottom portion being opposite the top portion and located at a hot side of the liner panel.

In addition to one or more of the features described above, or as an alternative to any of the foregoing embodiments, the converging contoured inner wall portion has a first inner periphery defining a portion of a first cross-sectional area of the dilution passage and a second inner periphery defining a portion of a second cross-sectional area of the dilution passage, the second inner periphery being smaller than that of the first inner periphery.

In addition to one or more of the features described above, or as an alternative to any of the foregoing embodiments, the backstop has a curvature that matches a curvature of a portion of the dilution passage.

In addition to one or more of the features described above, or as an alternative to any of the foregoing embodiments, the backstop is arranged to be at least partially located at a trailing edge portion of the dilution passage and the converging contoured inner wall portion is located at a leading edge portion of the dilution passage.

Also disclosed is a method of guiding airflow into a combustor of a gas turbine engine, the method including: locating a portion of an annular grommet in an opening of a support shell of the combustor, the annular grommet extending from a liner panel secured to the support shell, the annular grommet defining a dilution passage; and directing airflow into the dilution opening via a backstop extending from a top portion of the annular grommet, the top portion defining a portion of a periphery of the dilution opening.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the FIGS.

Figure 1:
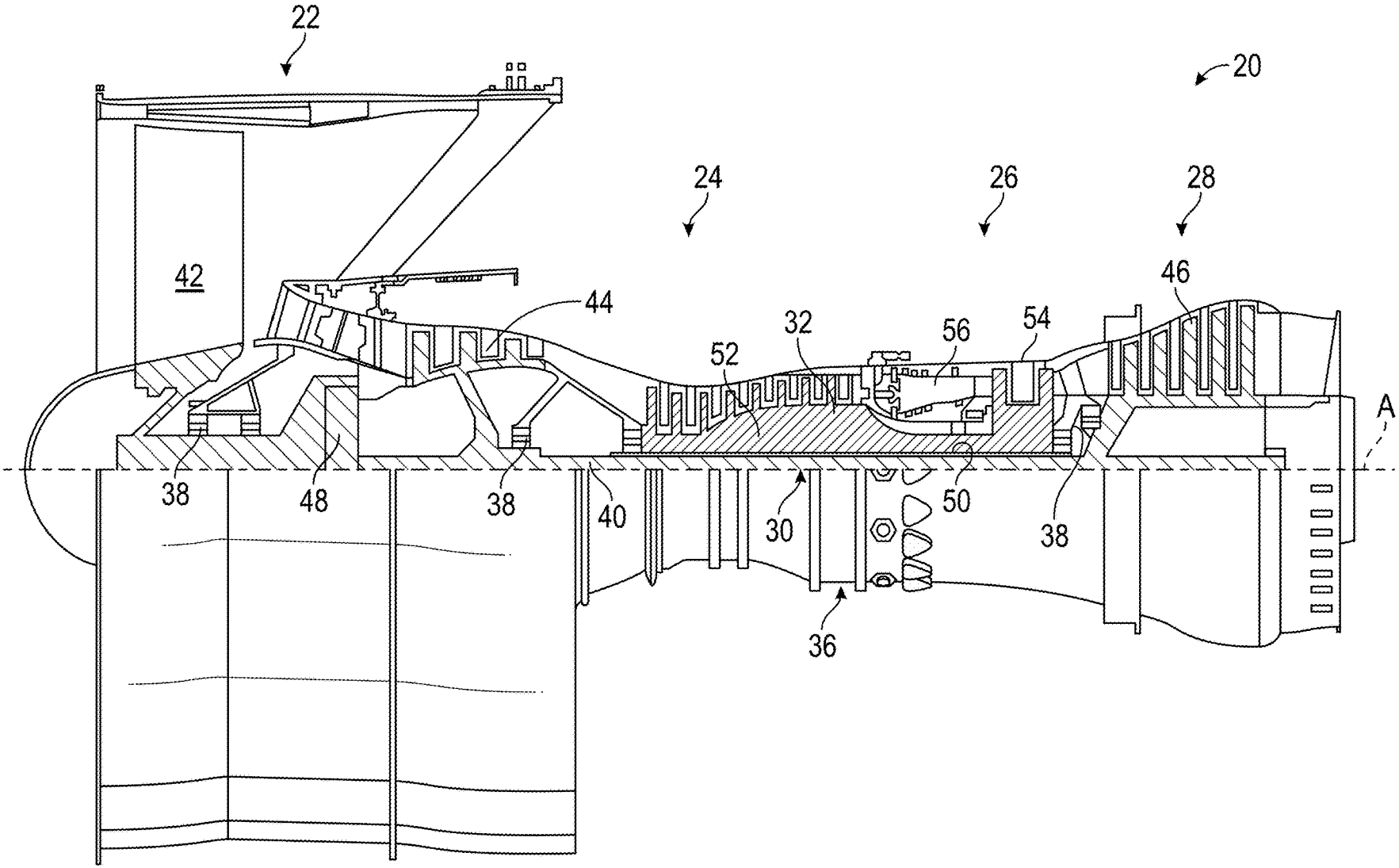
FIG. 1 is a schematic, partial cross-sectional view of a gas turbine engine in accordance with this disclosure.
Figure 2:
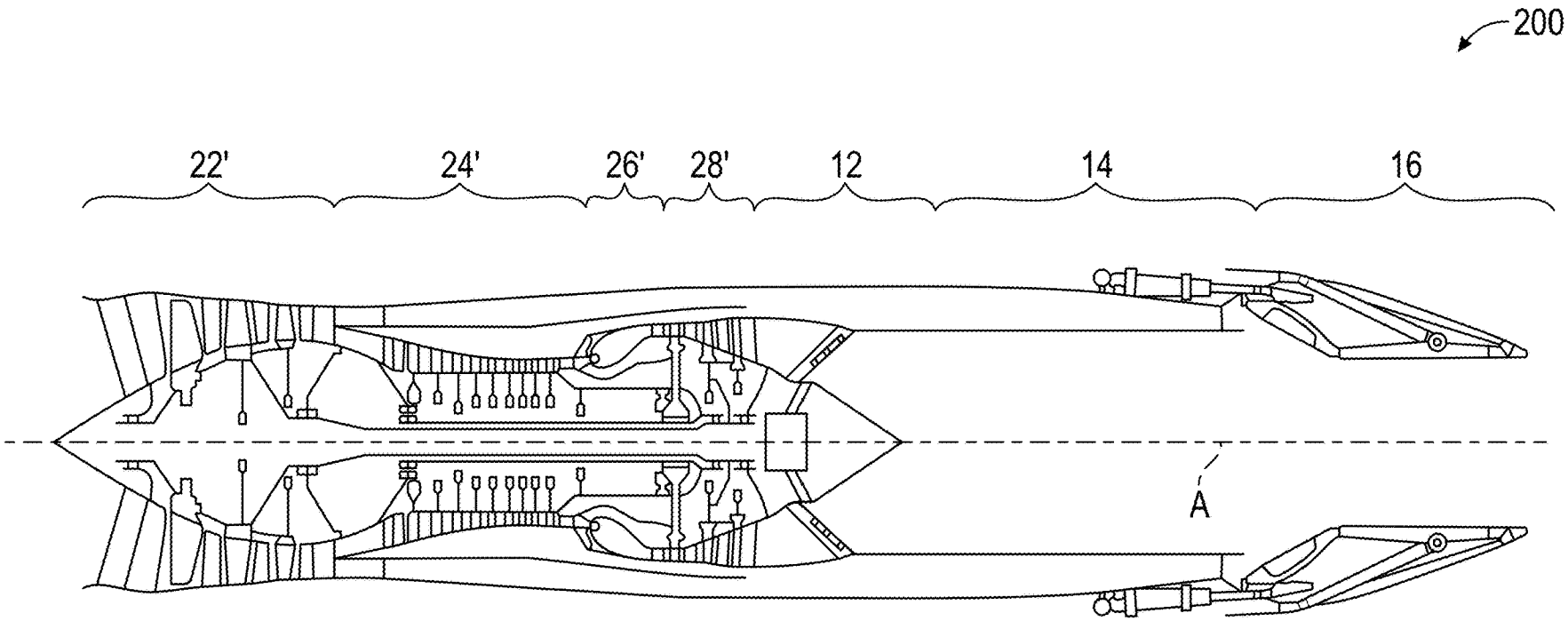
FIG. 2 is schematic cross-section of another example gas turbine engine.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Referring to FIG. 2, alternative engine architectures 200 might include an augmentor section 12, an exhaust duct section 14 and a nozzle section 16 in addition to the fan section 22', compressor section 24', combustor section 26' and turbine section 28' among other systems or features. Referring again to FIG. 1, the fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be understood that the concepts described herein are not limited to use with turbofans as the teachings may be applied to other types of turbine engines such as a turbojets, turboshafts, and three-spool (plus fan) turbofans wherein an intermediate spool includes an intermediate pressure compressor ("IPC") between a low pressure compressor ("LPC") and a high pressure compressor ("HPC"), and an intermediate pressure turbine ("IPT") between a high pressure turbine ("HPT") and a low pressure turbine ("LPT").

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 may drive the fan 42 directly, or through a geared architecture 48 as illustrated in FIG. 1 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and a high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and the low pressure turbine 46. The low pressure turbine 46 and the high pressure turbine 54 rotationally drive the respective low spool 30 and the high spool 32 in response to the expansion. The main engine shafts 40, 50 are supported at a plurality of points by the bearing structures 38 within the static structure 36. It should be understood that various bearing structures 38 at various locations may alternatively or additionally be provided.

Figure 3:
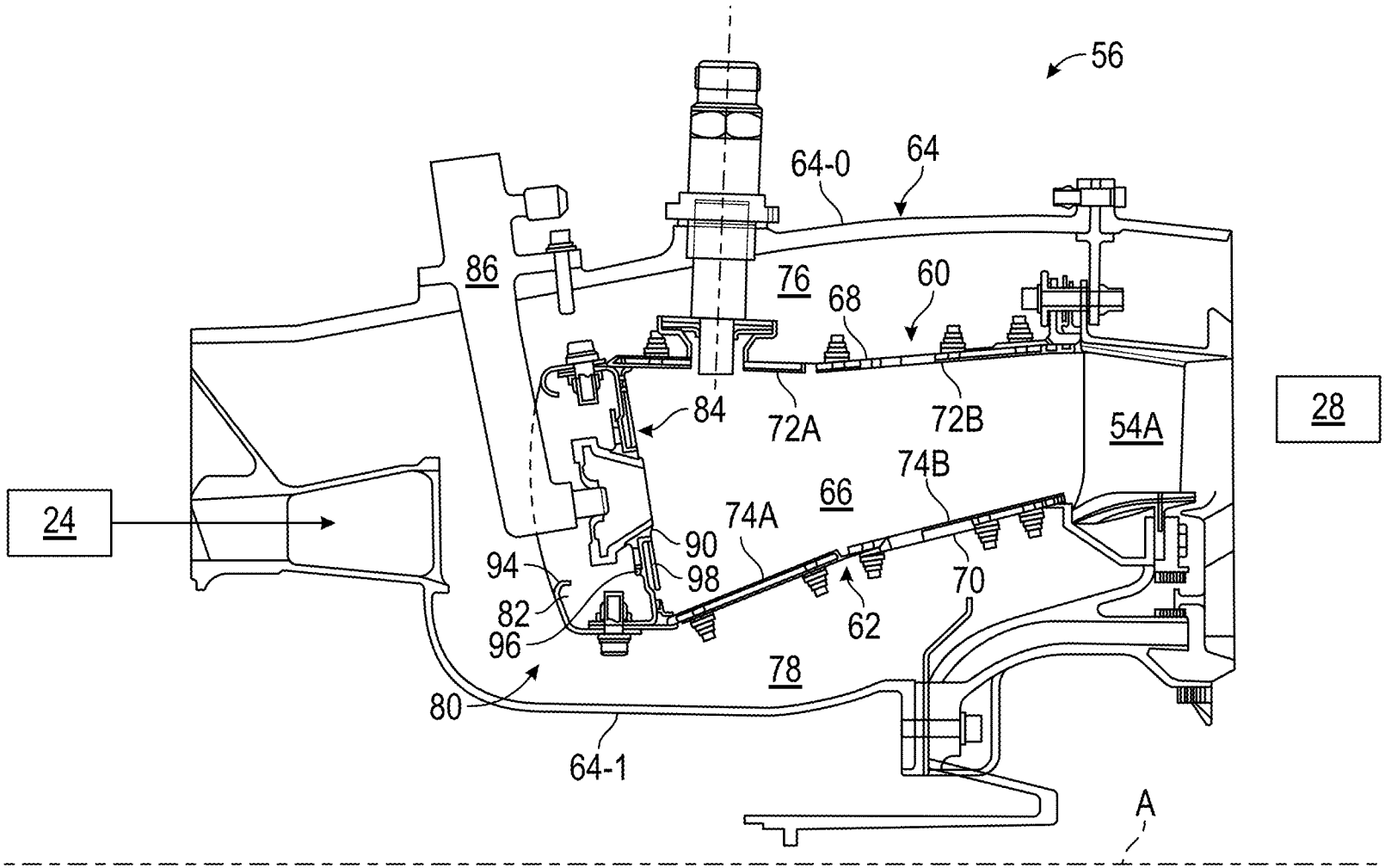
FIG. 3 is an expanded longitudinal schematic sectional view of a combustor section that may be used with the example gas turbine engine architectures shown in FIGS. 1 and 2.

With reference to FIG. 3, the combustor section 26 generally includes the combustor 56 with an outer combustor wall assembly 60, an inner combustor wall assembly 62 and a diffuser case module 64 therearound. The outer combustor wall assembly 60 and the inner combustor wall assembly 62 are spaced apart such that an annular combustion chamber 66 is defined therebetween.

The outer combustor wall assembly 60 is spaced radially inward from an outer diffuser case 64-O of the diffuser case module 64 to define an outer annular plenum 76. The inner combustor wall assembly 62 is spaced radially outward from an inner diffuser case 64-I of the diffuser case module 64 to define an inner annular plenum 78. It should be understood that although a particular combustor is illustrated, other combustor types with various combustor liner arrangements will also benefit therefrom. It should be further understood that the disclosed cooling flow paths are but an illustrated embodiment and should not be limited only thereto.

The combustor wall assemblies 60, 62 contain the combustion products for direction toward the turbine section 28. Each combustor wall assembly 60, 62 generally includes a respective support shell 68, 70 which supports one or more liner panels 72, 74 mounted thereto. Each of the liner panels 72, 74 may be generally rectilinear and manufactured of, for example, a nickel based super alloy, ceramic or other temperature resistant material and are arranged to form a liner array. In the liner array, a multiple of forward liner panels 72A and a multiple of aft liner panels 72B are circumferentially staggered to line the outer shell 68. A multiple of forward liner panels 74A and a multiple of aft liner panels 74B are circumferentially staggered to also line the inner shell 70.

The combustor 56 further includes a forward assembly 80 immediately downstream of the compressor section 24 to receive compressed airflow therefrom. The forward assembly 80 generally includes an annular hood 82, a bulkhead assembly 84, and a multiple of swirlers 90 (one shown). Each of the swirlers 90 is circumferentially aligned with one of a multiple of fuel nozzles 86 (one shown) and the respective hood ports 94 to project through the bulkhead assembly 84. The bulkhead assembly 84 includes a bulkhead support shell 96 secured to the combustor walls 60, 62, and a multiple of circumferentially distributed bulkhead liner panels 98 secured to the bulkhead support shell 96 around each respective swirler opening 92. The bulkhead support shell 96 is generally annular and the multiple of circumferentially distributed bulkhead liner panels 98 are segmented, typically one to each fuel nozzle 86 and swirler 90.

The annular hood 82 extends radially between, and is secured to, the forwardmost ends of the combustor wall assemblies 60, 62. The annular hood 82 includes the multiple of circumferentially distributed hood ports 94 that receive one of the respective multiple of fuel nozzles 86 and facilitates the direction of compressed air into the forward end of the combustion chamber 66 through a respective one of the swirler openings 92. Each fuel nozzle 86 may be secured to the diffuser case module 64 and project through one of the hood ports 94 into the respective swirler 90.

The forward assembly 80 introduces core combustion air into the forward section of the combustion chamber 66 while the remainder enters the outer annular plenum 76 and the inner annular plenum 78. The multiple of fuel nozzles 86 and adjacent structure generate a blended fuel-air mixture that supports stable combustion in the combustion chamber 66.

Opposite the forward assembly 80, the outer and the inner support shells 68, 70 are mounted adjacent to a first row of nozzle guide vanes (NGVs) 54A in the high pressure turbine 54. The nozzle guide vanes 54A are static engine components which direct core airflow combustion gases onto the turbine blades of the first turbine rotor in the turbine section 28 to facilitate the conversion of pressure energy into kinetic energy. The core airflow combustion gases are also accelerated by the nozzle guide vanes 54A because of their convergent shape and the gases are typically given a "spin" or a "swirl" in the direction of turbine rotor rotation. The turbine rotor blades absorb this energy to drive the turbine rotor at high speed.

Figure 4:
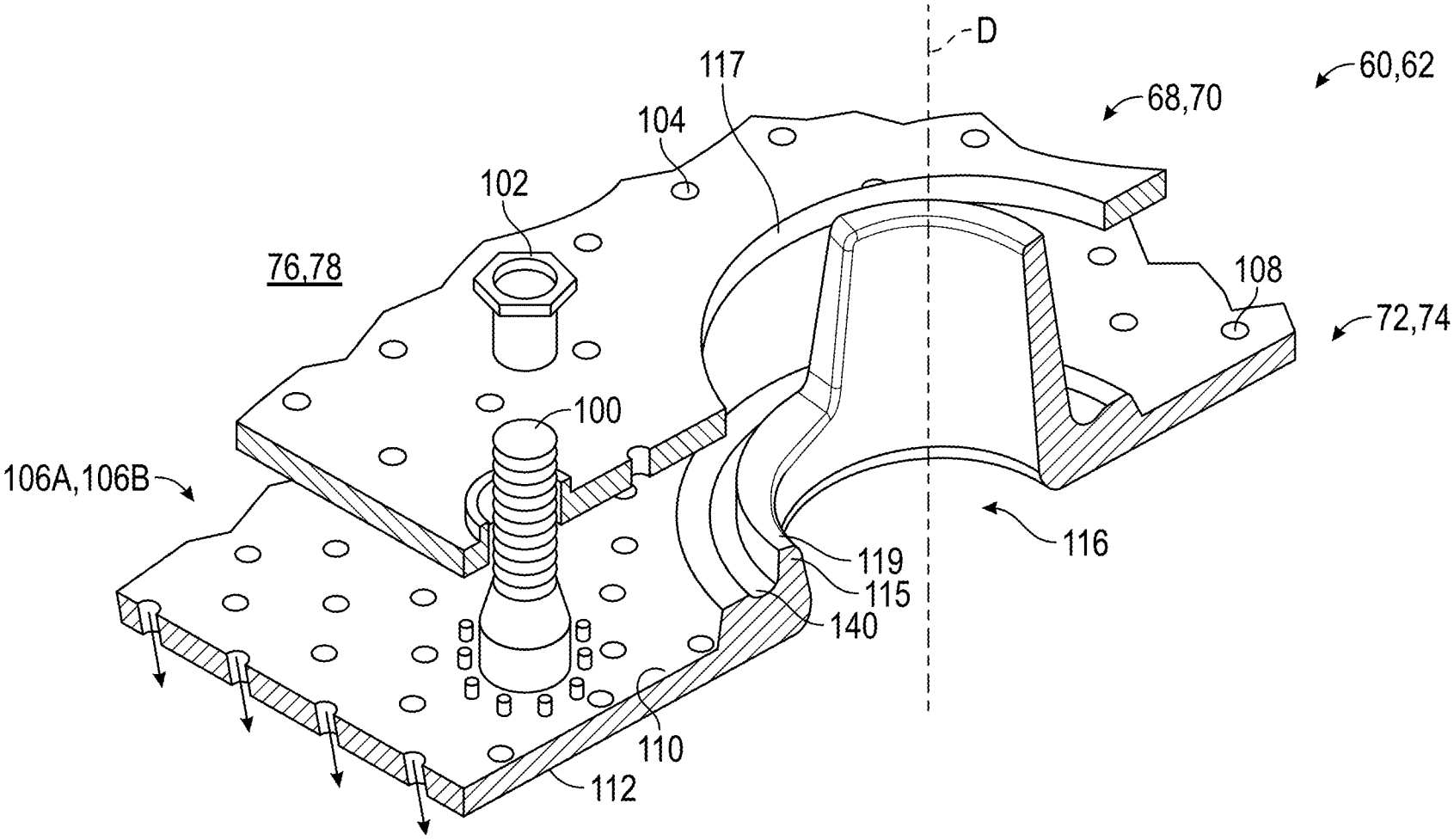
FIG. 4 is an exploded view of a wall assembly with a dilution passage in accordance with the present disclosure.

With reference to FIG. 4, a plurality of studs 100 extend from the liner panels 72, 74 so as to permit the liner panels 72, 74 to be mounted to their respective support shells 68, 70 with fasteners 102 such as nuts. That is, the studs 100 project rigidly from the liner panels 72, 74 and through the respective support shells 68, 70 to receive the fasteners 102 at a threaded distal end section thereof.

A multiple of cooling impingement passages 104 penetrate through the support shells 68, 70 to allow air from the respective annular plenums 76, 78 to enter cavities 106A, 106B formed in the combustor wall assemblies 60, 62 between the respective support shells 68, 70 and liner panels 72, 74. The cooling impingement passages 104 are generally normal to the surface of the liner panels 72, 74. The air in the cavities 106A, 106B provides cold side impingement cooling of the liner panels 72, 74. As used herein, the term impingement cooling generally implies heat removal from a part via an impinging gas jet directed at a part.

A multiple of effusion passages 108 penetrate through each of the liner panels 72, 74. The geometry of the passages (e.g., diameter, shape, density, surface angle, incidence angle, etc.) as well as the location of the passages with respect to the high temperature main flow also contributes to effusion film cooling. The combination of impingement passages 104 and effusion passages 108 may be referred to as an Impingement Film Floatwall (IFF) assembly.

The effusion passages 108 allow the air to pass from the cavities 106A, 106B defined in part by a cold side 110 of the liner panels 72, 74 to a hot side 112 of the liner panels 72, 74 and thereby facilitate the formation of thin, cool, insulating blanket or film of cooling air along the hot side 112. The effusion passages 108 are generally more numerous than the impingement passages 104 to promote the development of film cooling along the hot side 112 to sheath the liner panels 72, 74. Film cooling as defined herein is the introduction of a relatively cooler air at one or more discrete locations along a surface exposed to a high temperature environment to protect that surface in the region of the air injection as well as downstream thereof.

A plurality of dilution passages 116 penetrate through both the respective support shells 68, 70 and liner panels 72, 74 along a common axis D. For example only, in a Rich-Quench-Lean (R-Q-L) type combustor, the dilution passages 116 are located downstream of the forward assembly 80 to quench the hot combustion gases within the combustion chamber 66 by direct supply of cooling air from the respective annular plenums 76, 78. In one non-limiting embodiment, the dilution passages 116 are formed by an annular grommet or peripheral wall 115 extending upwardly from the cold side of the liner panels 72, 74. The peripheral wall 115 being received within an opening 117 in shells 68, 70 when the liner panels 72, 74 and the shells 68,70 are assembled together. The peripheral wall 115 terminates at a top portion 119 and a backstop or extended wall portion 121 extends upwardly from the top portion 119 of the peripheral wall 115. In other words, top portion 119 forms a portion of a periphery of the dilution passage and the backstop 121 forms another portion or the remaining portion of a periphery of the dilution passage 116. In one embodiment, the peripheral wall 115, backstop 121 and liner panels 72, 74 are integrally formed as a single unitary structure or in other words, they are formed as a single piece.

Figure 5:
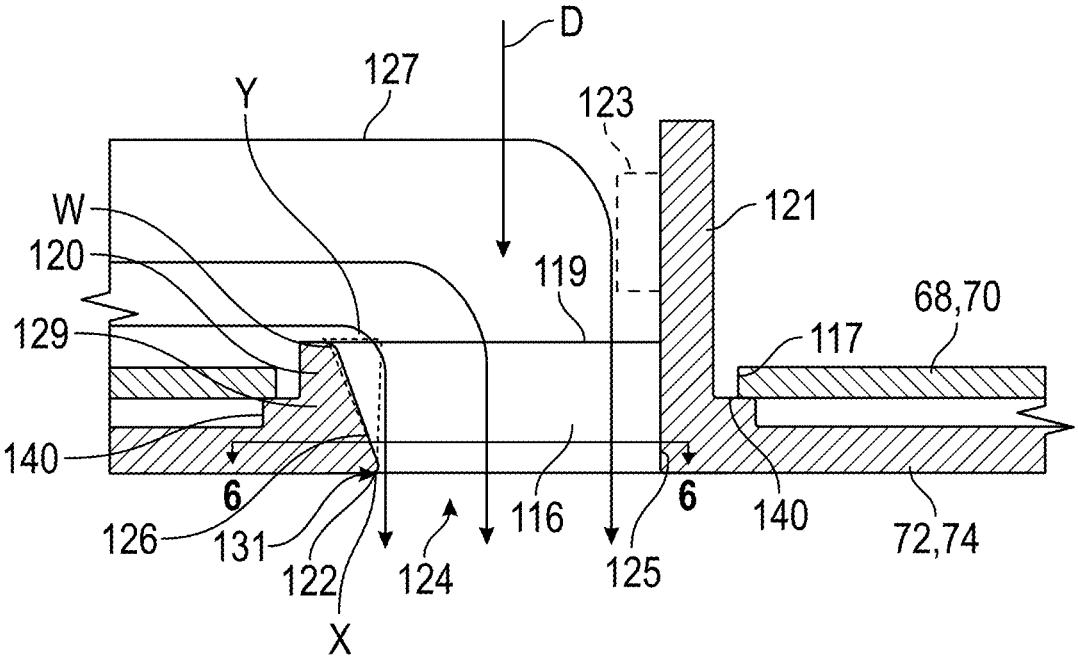
FIG. 5 is cross-sectional views of a dilution passage in accordance with the present disclosure.
Figure 7:
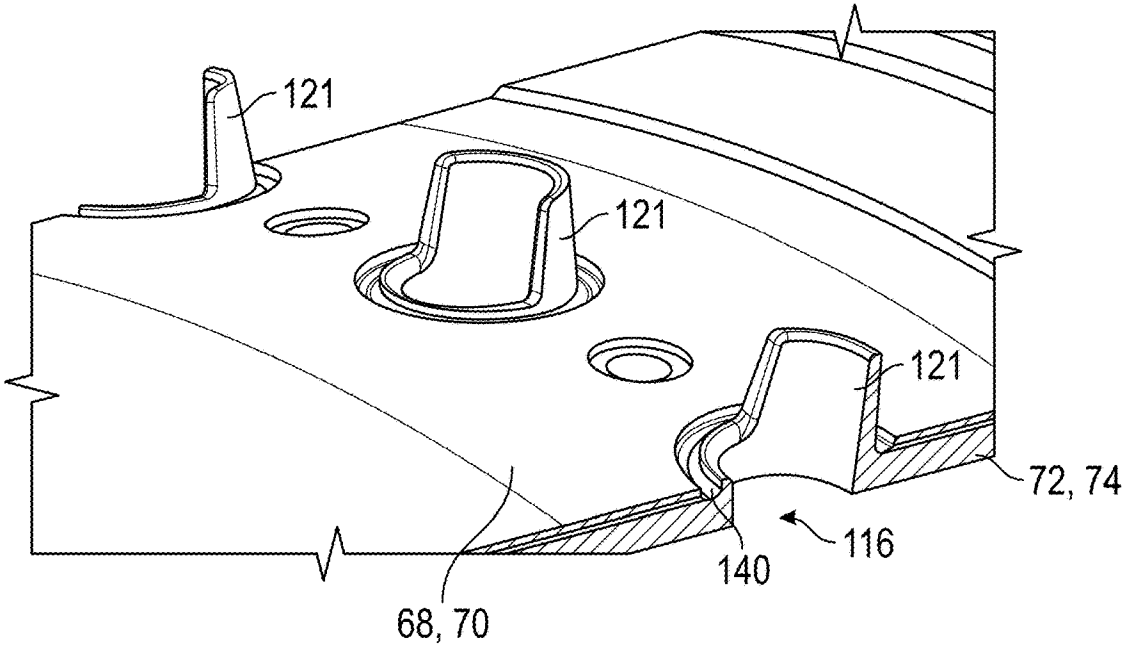
FIG. 7 is a partial cross-sectional perspective view of a wall assembly with a dilution passage in accordance with the present disclosure.

With reference to FIG. 5 and as mentioned above, at least one of the multiple of dilution passages 116 includes a backstop 121 extending upwardly and away from the peripheral wall 117 extending from the liner panels 72, 74 proximate to a peripheral portion of the dilution passage 116. The backstop 121 partially circumscribes each or a subset of the dilution passages 116. As used herein a subset of dilution passages may also be referred to as a sector. In one non-limiting embodiment, the backstops 121 are symmetric. However, alternate embodiments could incorporate intentional asymmetries. For example, the backstop 121 could be rotated about the dilution passage centerline D, and/or a vortex generator 123 could be added to one side of the backstop 121. As illustrated, the backstop 121 may have a curvature that matches a curvature of the dilution opening 116.

As illustrated and in one embodiment, the backstop 121 is arranged to be at least partially located at a trailing edge portion 125 of the dilution passage 116. As such, air flow (illustrated by arrows 127) will contact the backstop 121 and be directed into the dilution passage 116. In addition, and at the opposite end or a leading edge 129 of the dilution passage 116 has a first internal periphery 120 and a second internal periphery 122 defined by the associated liner panels 72, 74 along axis D. The first internal periphery 120 located proximate to or at the top portion of the dilution passage 116 and the second internal periphery 122 located proximate or at a bottom portion of the dilution passage 116. As used herein, the "leading edge" refers to a portion of the dilution passage that faces the incoming airflow and the "trailing edge" refers to a portion of the dilution passage downstream from the "leading edge". In other words, the leading edge encounters the incoming airflow prior to the trailing edge. The first internal periphery 120 and the second internal periphery 122 form a portion of a contoured nozzle 124 that forms a local acceleration of airflow along a portion of a perimeter of the dilution passages 116 to minimize the likelihood of hot gas ingestion. That is, a contoured, converging wall surface of a portion of an inner wall 126 of the dilution passage 116 alters the incoming velocity profile of the dilution air jet to minimize hot gas ingestion and therefore improve the global durability of the combustor 56. The first internal periphery 120 and the second internal periphery 122 may be portions of various radial configurations such as circular or oval. It being understood that the first internal periphery 120 and the second internal periphery 122 may be only located on a portion of the inner wall 126 for example at the leading edge 129 of the dilution passage 116.

The second internal periphery 122 is smaller than that of the first internal periphery 120 such that the inner wall 126 defines a convex around axis D or funnel type shape. In one disclosed non-limiting embodiment, first internal periphery 120 defines a point W and the second internal periphery 122 defines a point X. A third point Y is defined with respect to point X axially parallel to axis D to form a triangle between points W, X, Y. Line XW and XY are perpendicular such that the contoured nozzle 124 may be generally defined by an angle $\alpha$ between line WY and WX of about twenty-five (25) degrees. It should be appreciated that this is but one example geometry for a contoured converging dilution passages 116 and that other geometries will also benefit therefrom.

By contouring a portion of the inner wall 126 of the dilution passage 116 at the leading edge 129 of the dilution passage 116, the discharge coefficient is increased to facilitate a passage that generates similar flow to that of a relatively larger conventional straight wall passage. The resultant reduced area of the incoming dilution air jet forms a smaller stagnation area upstream of the dilution passages 116 to further improve durability. By contouring the inner periphery 120, 122 of the dilution passages 116, the discharge coefficient is also increased which allows for the use of a smaller diameter hole to generate identical flows. The resultant reduced area of the incoming dilution air jet may form a relatively smaller stagnation area upstream of the dilution passages 116.

As the dilution air jet directed through the contoured nozzle 124 does not deflect away from the inner surface when subjected to a cross or swirling flow, the hot recirculation zone is minimized if not eliminated. The reduction of hot spots adjacent to dilution passages 116 thereby permits utilization of the relatively limited cooling air elsewhere in the combustor allowing for the more efficient engine operation.

As such, the air flow remains attached at a location 131 of the dilution passage 116. In addition, and due to the backstop 121 the air flow at the opposite side of the dilution passage 116 remains attached to the portions of the dilution passage 116 proximate to the backstop 121. This being attributed to the use of the backstop 121 that extends from the peripheral edge of the dilution passage 116. Moreover and as illustrated in the attached FIGS. the inner wall surface 126 of the dilution passage 116 proximate to or extending from the backstop 121 is generally linear or strait as opposed to the contoured portion of the inner wall 126 of the dilution passage 116 at the leading edge 129 of the dilution passage 116.

Also shown is that an annular groove 140 is formed in the liner panel 72, 74. The annular groove 140 is formed in the cold side of the liner panel and surrounds a periphery of the annular grommet.

The beveled grommet or portion thereof (fillet along the leading edge of dilution passage inlet defined by the contours of the inner peripheries 120 and 122) reduces the sensitivity of the dilution passage discharge coefficient to manufacturing variations. This reduces variation in flowrate between a corresponding passage 116 in each sector, thus reducing sector-to-sector variations in total fuel-air ratio and hence reducing peak temperatures/pattern factor.

Figure 6:
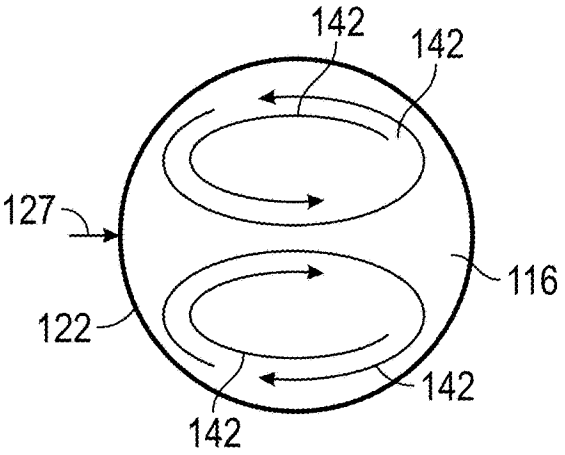
FIG. 6 is a schematic view illustrating cooling air flow along lines 6-6 of FIG. 5A through a dilution passage in accordance with the present disclosure.

Therefore, and through the use of at least backstop 121 and the contoured portion of the nozzle 124 (e.g., contoured inner periphery 120, 122 of the dilution passage 116) consistent vortexes 142 of air flow through the dilution passage 116 are provided. See at least FIG. 6 which is a view along lines 6-6 of FIG. 5A. Since the vortexes 142 of the air flow are consistent a circumferentially uniform combustor exit temperature distribution can be provided. By providing these consistent vortexes 142 of air flow minimal temperature variation between combustor sectors is provided which in turn, increases turbine life and performance.

In current designs, per-sector air flow pattern factors vary significantly, which requires a more conservative turbine cooling design. However, and by providing consistent vortexes 142 of air flow the combustor exit temperature profile and uniformity can be controlled using the aforementioned design of air dilution passages 116.

Since it is difficult to identify the sources of sector-to-sector variation and existing designs are potentially highly sensitive to manufacturing variations the present disclosure is particularly useful in providing circumferentially uniform combustor exit temperature, which due to the consistent vortexes 142 provided by the designs of the present disclosure.

The contoured dilution passage (taper along leading edge of dilution passage) mitigates formation of a recirculation region inside dilution passage. This may reduce variation in mixing between dilution jets, as the size and dynamics of the recirculation region could modulate the jet penetration and mixing.

In addition, the backstop 121 guides flow into and through the dilution passage 116. The ensures that flow in and through each dilution passage 116 is the same, reducing passage-to-passage (and hence sector-to-sector) variation in mixing between dilution jets and combustor head end flow.

Alternative embodiments could incorporate intentional asymmetries to the backstop 121 (e.g., rotate the collar so that one side leads the other) to further influence passage air flow such that small asymmetries due to manufacturing do not control the overall mixing between the dilution jet and crossflow.

As such, the present disclosure provides an apparatus and method for providing uniformity to the combustor exit temperature profile, which in turn can increase turbine life and performance.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit therefrom.

Although particular step sequences are shown, described, and claimed, it should be understood that steps may be performed in any order, separated or combined unless otherwise indicated and will still benefit from the present disclosure.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed is:

1. A wall assembly for use in a combustor of a gas turbine engine, the wall assembly comprising:

a support shell;

a liner panel, the liner panel being separately secured to the support shell; and an annular grommet extending from the liner panel, the annular grommet defining a dilution passage having a dilution passage axis and the annular grommet extends through an opening in the support shell when the support shell and the liner panel are secured to each other, the annular grommet having a top portion that defines a portion of a periphery of the dilution passage; and a backstop extending from the top portion of the annular grommet, the backstop defining another portion of the periphery of the dilution passage and the backstop extending through and above the opening in the support shell when the liner panel is secured to the support shell, wherein a portion of an inner wall of the annular grommet includes a linearly converging contoured inner wall portion that extends from the top portion to a bottom portion of the annular grommet, the bottom portion being opposite the top portion and located at a hot side of the liner panel, the linearly converging contoured inner wall portion has a first inner periphery defining a portion of a first cross-sectional area of the dilution passage and a second inner periphery defining a portion of a second cross-sectional area of the dilution passage, the second inner periphery being smaller than that of the first inner periphery and the linearly converging contoured inner wall portion is only located at a leading edge portion of the dilution passage and the inner wall of the annular grommet to or extending from the backstop is linear and parallel to the dilution passage axis from the backstop to the bottom portion of the annular grommet.

2. The wall assembly of claim 1, wherein the backstop has a curvature that matches a curvature of a portion of the dilution passage.

3. The wall assembly of claim 2, wherein the converging contoured inner wall portion converges toward the dilution passage axis.

4. The wall assembly of claim 1, wherein the backstop is arranged to be at least partially located at a trailing edge portion of the dilution passage.

5. The wall assembly of claim 1, wherein the first inner periphery and the second inner periphery define a portion of a contoured nozzle that forms local acceleration of airflow along a portion of a perimeter of the dilution passage.

6. The wall assembly of claim 1, wherein the backstop has a vortex generator.

7. A gas turbine engine, comprising:

a compressor section;

a turbine section; and a combustor section, the combustor section including a wall assembly for use in a combustor of the combustor section, the wall assembly comprising:

a support shell;

a liner panel, the liner panel being separately secured to the support shell; and an annular grommet extending from the liner panel, the annular grommet defining a dilution passage having a dilution passage axis and the annular grommet extends through an opening in the support shell when the support shell and the liner panel are secured to each other, the annular grommet having a top portion that defines a portion of a periphery of the dilution passage; and a backstop extending from the top portion of the annular grommet, the backstop defining another portion of the periphery of the dilution passage and the backstop extending through and above the opening in the support shell when the liner panel is secured to the support shell, wherein a portion of an inner wall of the annular grommet includes a linearly converging contoured inner wall portion that extends from the top portion to a bottom portion of the annular grommet, the bottom portion being opposite the top portion and located at a hot side of the liner panel, the linearly converging contoured inner wall portion has a first inner periphery defining a portion of a first cross-sectional area of the dilution passage and a second inner periphery defining a portion of a second cross-sectional area of the dilution passage, the second inner periphery being smaller than that of the first inner periphery and the linearly converging contoured inner wall portion is only located at a leading edge portion of the dilution passage and the inner wall of the annular grommet or extending from the backstop is linear and parallel to the dilution passage axis from the backstop to the bottom portion of the annular grommet.

8. The gas turbine engine of claim 7, wherein the backstop has a curvature that matches a curvature of a portion of the dilution passage.

9. The gas turbine engine of claim 7, wherein the backstop is arranged to be at least partially located at a trailing edge portion of the dilution passage.

10. A method of guiding airflow into a combustor of a gas turbine engine, the method comprising:

locating a portion of an annular grommet in an opening of a support shell of the combustor, the annular grommet extending from a liner panel secured to the support shell, the annular grommet defining a dilution passage, the liner panel being separately secured to the support shell; and directing airflow into the dilution passage via a backstop extending from a top portion of the annular grommet, the top portion defining a portion of a periphery of the dilution passage, wherein a portion of an inner wall of the annular grommet includes a linearly converging contoured inner wall portion that extends from the top portion to a bottom portion of the annular grommet, the bottom portion being opposite the top portion and located at a hot side of the liner panel, the linearly converging contoured inner wall portion has a first inner periphery defining a portion of a first cross-sectional area of the dilution passage and a second inner periphery defining a portion of a second cross-sectional area of the dilution passage, the second inner periphery being smaller than that of the first inner periphery and the linearly converging contoured inner wall portion is only located at a leading edge portion of the dilution passage and the inner wall of the annular grommet extending from the backstop is linear and parallel to the dilution passage axis from the backstop to the bottom portion of the annular grommet.

11. The method of claim 10, wherein a periphery of the annular grommet is surrounded by a groove in the liner panel.

12. The gas turbine engine of claim 7, wherein a periphery of the annular grommet is surrounded by a groove in the liner panel.

13. The wall assembly of claim 1, wherein a periphery of the annular grommet is surrounded by a groove in the liner panel.

* * * * *